United States Patent [19]

Chappell et al.

[11] Patent Number: 4,716,503

[45] Date of Patent: Dec. 29, 1987

[54] FLUORESCENT DISPLAY BASE

[75] Inventors: Richard L. Chappell; Alice M. Chappell, both of New York, N.Y.

[73] Assignee: Fine Lines International Ltd., New York, N.Y.

[21] Appl. No.: 652,202

[22] Filed: Sep. 20, 1984

[51] Int. Cl.[4] ..... F21S 3/00; G09G 13/04

[52] U.S. Cl. ..... 362/97; 362/223; 362/260; 315/DIG. 5

[58] Field of Search ..... 362/368, 217, 218, 220, 362/222, 223, 260, 285, 295, 300, 311, 341, 84, 154, 97, 125; 315/DIG. 2, DIG. 5, 219, 206, 291; 40/367

[56] References Cited

U.S. PATENT DOCUMENTS

| | | | |
|---|---|---|---|
| 3,184,585 | 5/1965 | Rouy | 362/97 |
| 3,686,529 | 8/1972 | Boland | 362/218 |
| 4,104,715 | 8/1978 | Lawson, Jr. | 315/DIG. 5 |
| 4,184,194 | 1/1980 | Shofu | 362/97 |
| 4,185,407 | 1/1980 | Lamb | 40/367 |
| 4,253,046 | 2/1981 | Gerhard et al. | 315/DIG. 7 |
| 4,266,165 | 5/1981 | Handler | 315/DIG. 7 |
| 4,277,726 | 7/1981 | Burke | 315/205 |
| 4,287,456 | 9/1981 | Kovacik et al. | 362/221 |
| 4,367,434 | 1/1983 | Miller | 315/240 |
| 4,464,708 | 8/1984 | Nussli et al. | 362/223 |
| 4,488,090 | 12/1984 | Hancock | 315/220 |
| 4,493,013 | 1/1985 | Hawkins | 362/368 |

*Primary Examiner*—Willis R. Wolfe, Jr.
*Attorney, Agent, or Firm*—Auslander & Thomas

[57] ABSTRACT

A fluorescent display base is provided with a maximum light display with a minimum of distortion in a cool environment adapted for portability and home use, particularly in the artistic display of glass. The configuration of remote step-down transformer and minimal internal structure withint the reflective case provides a cool display base heated very little above ambient atmospheric temperature and safety protected against high voltage running into the base.

12 Claims, 7 Drawing Figures

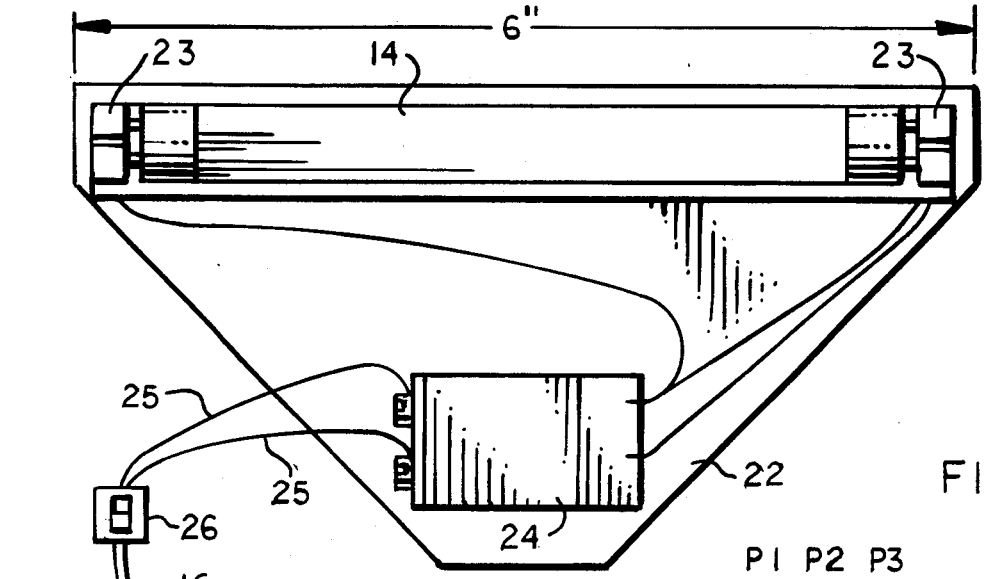
FIG.5
FIG.6a
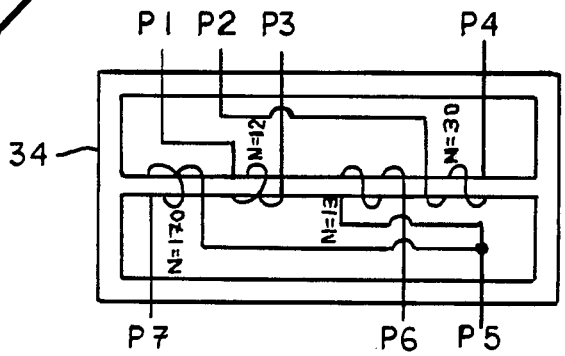
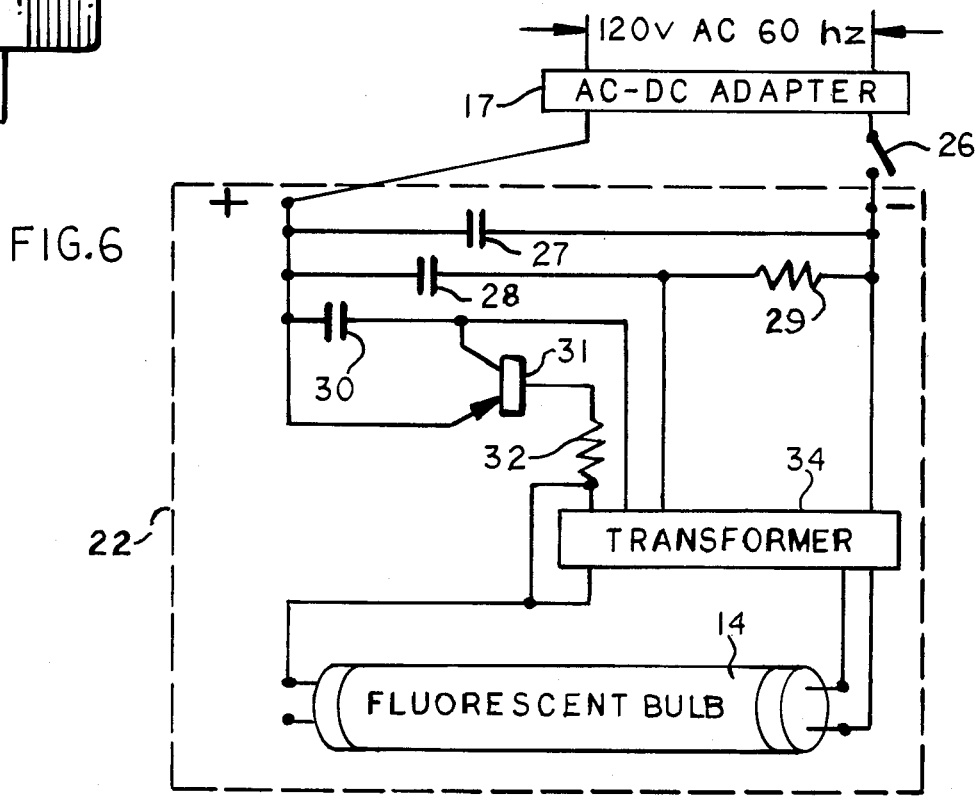
FIG.6

FLUORESCENT DISPLAY BASE

The present invention is for a fluorescent light display base particularly adapted for the home display of artistic glass objects.

Fluorescent display bases of the past were used primarily in stores, galleries and museums. They tended to be heavy bulky and to heat up in use notwithstanding the use of 4 watt fluorescent tubes.

The display bases of the past often times were haunted by shadows distorting the lighting characteristics of the base and of the the displayed articles.

Heat from displays of the past has been a problem heating the object being displayed as well as the cabinets, creating a potential fire hazard or at a minimum the discomfort of the heat of the base including the risk of a burn.

The 120 volt A.C. line cord to the display base of the past could be unesthetic and presented a possible electrical hazard with the 120 volt line stretching from the outlet to the display base.

The presence of the bulk of the step-down transformer in the display base of the prior art tended to create the shadows and absorb light within the display base. The bulk of the transformer necessitated a base with dimensions sufficient to accommodate it. The transformer further rendered the display base heavy and unwieldly and imposed necessary size and weight limitations which made it difficult to have an easily usable, portable display base which could be small and flexible as to how and where it was to be used.

It is an object of the present invention to provide an adaptable white light portable, fluorescent light, display base, primarily for home use, particularly adapted to display crystal glass, the display base providing cool diffuse lighting.

Another object of the present invention is to provide an inexpensive display base having a plastic case and excellent internal light-reflective characteristics.

Another object of the present invention is to provide a thin, small plastic display base with a translucent surface adapted to support the object to be displayed.

Another object of the present invention is to provide a display base operable with low voltage current within the display base.

Another object of the present invention is to provide a display base with a 4 watt fluorescent tube, or other low wattage tube operated from a step-down transformer having a 6 volt, or other low voltage supply situated outside the display base.

According to the present invention a fluorescent light display base is provided including a case, the case having side walls, an open bottom, an open top and a translucent top portion. The translucent top portion is integrally attached to the top portion of the case. The bottom portion is engaged in the open bottom of the case and mounts at least one fluorescent tube and fluorescent starter and a DC-AC step-up transformer circuit. The external transformer is adapted to connect directly to a 120 volt outlet away from the display base. Wires from the external transformer pass through the case to actuate the starter and fluorescent tube.

The display base may include an open top with an inward flange, with the translucent top portion cemented below the flange and within the case, thus providing a protective rim. The entire inner portion of the case other than the translucent top is preferably a reflective white. The display base may include a fluorescent starter on a printed circuit board including a step-up AC transformer. The light is preferably at least one fluorescent 4 watt tube or other low wattage tube. The wire from the transformer is a low voltage wire such as bell wire. The case is preferably made of plastic such as high-impact styrene with the translucent top, a translucent plastic. The external transformer directly connects to a 120 volt outlet with male contact blades. The fluorescent tube and fluorescent stater may be directly mounted on a base attachable to the bottom board and the fluroresent starter may be on a printed circuit board which includes a low voltage DC-AC step-up transformer circuit.

Although such novel feature or features believed to be characteristic of the invention are pointed out in the claims, the invention and the manner in which it may be carried out, may be further understood by reference to the description following and the accompanying drawings.

FIG. 5 is a view of another embodiment of the fluorescent tube mounting structure including its electrical circuitry.

FIG. 6 is a schematic of the fluorescent tube circuitry in FIG. 5.

FIG. **6*a* is a schematic detail of the form of circuitry in FIG. 6**.

Referring now to the figures in great detail, where like reference numbers denote like parts in the various figures.

Figure 1:
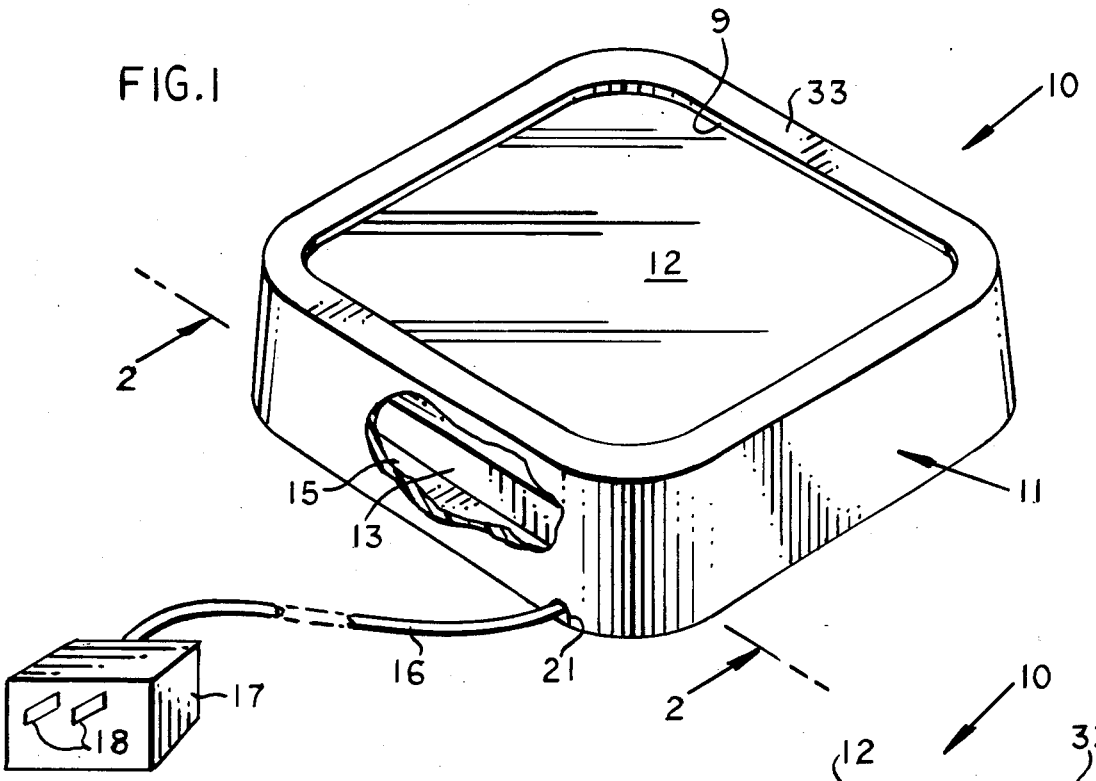
FIG. 1 is an isometric view of the display base of the present invention partially broken away.
Figure 2:
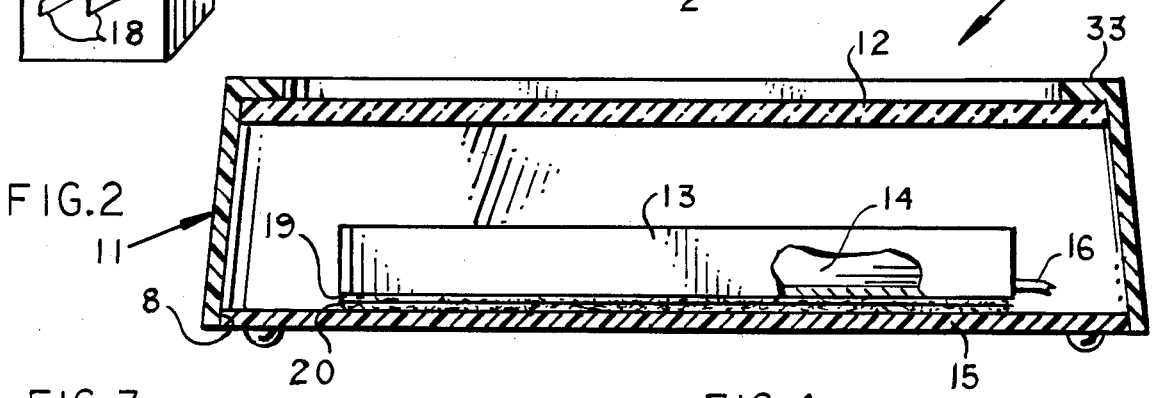
FIG. 2 is a section of FIG. 1 along lines 2—2 partially broken away.
Figure 3:
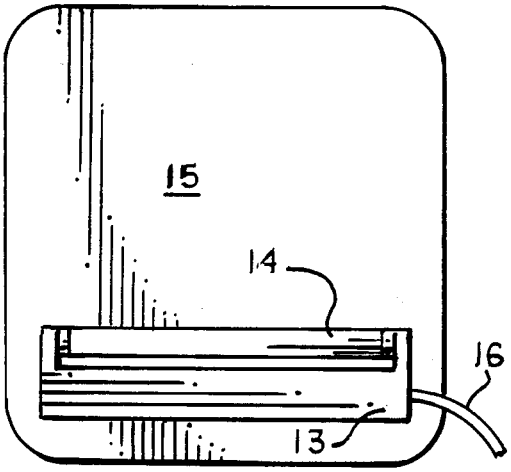
FIG. 3 is a top plan view of the bottom board of the display base.

The display base 10, as shown in FIGS. 1 and 2, includes a plastic case 11 with an open top 9, an open bottom 8 and a translucent top 12 across the opening 9. The fluorescent mount 13 holds a fluorescent tube 14 as shown in FIGS. 1–3. The mount 13 is mounted on the bottom board 15 as shown in FIG. 3. A line cord 16 substantially of bell wire or other low voltage wire, extends from the mount 13 and leads to a step-down transformer 17 located outside the display base 10. There are contact blades 18 extending from the transformer 17 adapted to plug into a conventional electrical outlet (not shown).

The fluorescent mount 13 as shown in FIG. 2 includes one piece of a mating fabric connector 19 such as Velcro®. The other mating piece 20 of said mating connector, such as Velcro® is attached to the bottom board 15. Thus, the fluorescent mount 13 is easily attached to the bottom board 15 by pressure placement. The bottom board 15 itself is press fittable into the opening 8 formed by the side walls of the case 11. A small opening 21 in the case 11 allows the line cord 16 to pass through the case so that power may be received by the fluorescent tube 14 to illuminate the display base 10.

Figure 4:
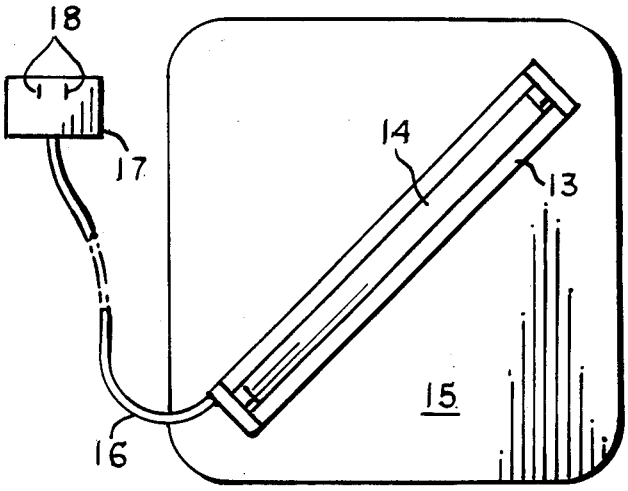
FIG. 4 is a top plan view of an alternate embodiment of the bottom board of the display base.

In FIG. 4 the fluorescent mount 13 is shown alternately mounted on the bottom board 15 by means, not shown.

The basic electronics for the fluorescent tube 14 are contained in the mount 13 and includes a starter circuit and DC to AC, low voltage transformer (not shown).

The inside of the case 11, the line cord 16 within the case 11 and the fluorescent mount 13 are preferably a reflective white so as to obtain a maximum undistorted reflection of the fluorescent light through the translucent top 12. As shown in FIG. 4 the fluorescent mount 13 may be positioned alternately in order to obtain a desired light effect. More than one fluorescent tube 14 might be mounted consistent with the disclosure of the present invention.

The translucent top 12 is cemented to the flange 33 of the top opening 9 of the case 11, which extends approximately 7/16 of a inch inward.

The case 11 is preferably a medium impact styrene. The translucent top 12 is preferably a Plexiglass® acrylite top. The bottom board 15 is preferably Masonite® and pressure fits within the bottom opening 8 of the case 11, as can be seen in FIG. 2. The side walls of the case 11 may be slightly sloped.

In FIG. 5, an alternate fluorescent base 22 is disclosed mountable on the bottom board 15 by means known in the art. The fluorescent tube 14 is mounted on the base 22 in sockets 23 which are connected to a printed circuit board starter 24. The starter has lead wires 25 (bell wire) to a switch 26 which is connected to the line cord 16 and the 6 volt AC-DC transformer 17 attachable at a 120 volt AC outlet. Of course, other low voltage may be appropriately used in the transformer 17. The elements and wires are all white so as to minimize internal light absorption. The printed circuit board 24 has a low profile and does not take up much space.

In FIG. 6, a schematic of the circuitry, particularly as shown in FIG. 5, as set forth. The fluorescent tube 14 is mounted on the base 22. Sixty Hz, 120 volt, current source is received at the outlet by the 6 volt AS-DC 60 Hz, 500–600 milliamp, AC-DC transformer 17. The current is in parallel with the capacitor 27, preferably a 33 mfd, electrolytic capacitor and further in parallel with a second capacitor 28. The second capacitor 28 is a 0.001 mfd capacitor in series with an an 810 ohm resistor 29. A third 0.005 mfd capacitor 30 is in circuit with a transistor 31 and a 47 ohm resistor 32 which is in parallel with the transformer 34.

The internal circuitry of transformer 34 as disclosed in FIG. 6*a*, shows that resistor 32 is connected between the base of the transistor 31 and the terminals designated "p1" and "p7" The resistor 32 is series connected to each of the aforementioned terminals. However, the resistor is in parallel with the collector of the transistor 31 and the transformer connection "p2", and also the emitter and "p2" via the capacity 30. This parallel connection of this current with the transformer, discloses the other series connections as above mentioned.

The circuit includes a starter, igniting the fluorescent tube 14, after which the 6 volt DC current is connected by the secondary of the transformer 34 to provide approximately 30 to 35 volts AC across the fluorescent tube 14, thus supplying a bulb of only 4 watts from a remote 6 volt source.

The present invention, with the transformer 17, attached at an outlet and outside the case 11, had a 3.6° F. temperature increase over ambient temperature changing from from 79.7° F. to 83.3° F. within four hours. The conventional 4 watt fluorescent tube, including a transformer inside the case, had a 14.4° F. temperature increase over ambient changing from 78.8° F. to 93.2° F. within four hours. The present invention, thus has only a one fourth increase in temperature over ambient temperature of the prior art.

Improved safety of the present invention comes within Underwriter Laboratories Standard For Safety, 153 (portable electric lamps) dated Apr. 16, 1982, which is now currently in effect, and at page 25, paragraph 23.5 states: "A circuit supplied by a single source consisting of an isolating transformer need not be investigated if the open-circuit potential is not more than 30 volts rms (42.4 volts peak) and the energy available to the circuit is limited: A. So that the circuit under any condition of load including short cirucit is not more than 8 amperes measured after one minute of operation by (1) design of the isolating transformer or (2) design or value of a fixed impedance or reliable regulating network: or B. By a fuse . . . " (B. relates to alternate use of fuses and circuit breakers and is not quoted because it is not relevent to the present situation).

The use of the 120 volt AC-DC transformer 17, whose secondary output is 500 to 600 milliamps at 6 volts DC, accomplishes the low heat result and comes within Underwriters Laboratories standard, which does not need any further investigation for safety, according to the standard Underwriters Laboratories has established.

The ideal dimensions of the case 11 of the present invention are 7¾" square by 2¼" high. This case 11, with a 4 watt fluorescent tube 14 and a white interior of the display base 10, including white wires, provides an adequate light without glare.

With the fluorescent mount 13 on its side, as shown in FIGS. 1 through 3, the dimmest to brightest areas of the surface were related to by a ratio of less than 1:3 (1.6 foot candles to 4.6 foot candles based on a 1 square centimeter test area).

With the mount 13 in a vertical position, a brighter intensity was obtained with a slightly higher ratio (1:6) (14 foot candles to 60 foot candles for one tube and 8 foot candles to 50 foot candles for another.

While exact intensities may vary from tube to tube, the present invention developed a lighted base which can provide fluorescent illumination evenly distributed across the surface with intensity variations well below a factor of 10 for a given tube. The range of intensities, roughly 1 to 100 foot candles are sufficient for the purpose, without glare.

In operation, the display 10 of the present invention is suitably placed in position for convenient display, preferably of glass artworks or crystal glass works. The glass is placed on the transulcent top 12, the 6 volt 500 milliamp AC-DC transformer 17 is plugged into a conventional 120 volt outlet using the contact blades 18. The low voltage line cord 16, such as bell wire, leads from the transformer 17 to the display base 10. Where a switch 26 is provided, the switch is turned on after everything is in position. The limited space taken up by the fluorescent mount 13 and fluorescent tube 14, with the internal white reflective painting of the case 11 and all of the elements within the display base, provides excellent display for the desired object.

In the embodiment of FIGS. 5 and 6, using the alternate base 22, the base plate is preferably a white opaque Plexiglass®, which can be adhesively mounted or mounted with a double stick tape (not shown). The configuration of the fluorescent tube 14, sockets 23 and the small size of the printed circuit board 24, with white wires, provides a minimum of light absorption and distortions.

The terms and expressions which are employed are used as terms of description; it is recognized, though, that various modifications are possible.

It is also understood the following claims are intended to cover all of the generic and specific features of the invention herein described; and all statements of the scope of the invention which as a matter of language, might fall therebetween.

Having described certain forms of the invention in some detail, what is claimed is:

1. A low-intensity fluorescent light display stand for supporting and illuminating sculptures and art objects comprising a case, said case having side walls, said case having an open bottom and an open top, said open top including an inward flange, a translucent plastic top portion for supporting and illuminating sculptures and art objects, said translucent top portion integrally attached to said open top portion of said case at said flange, a bottom portion, said bottom portion adapted to be engageably held in said open bottom of said case, said bottom portion adapted to mount at least one fluorescent tube, a fluorescent starter disposed in said case and connected in series to a 120 volt AC-DC step-down transformer having means adapted to connect to a standard 120 volt outlet remote from said case, a low voltage DC-AC step-up transformer disposed inside said case and connected to said starter and to said AC-DC step-down transformer, said DC-AC step-up transformer connected in parallel to said fluorescent tube.

2. The display base of claim 1 wherein said fluorescent starter is a printed circuit board.

3. The display base of claim 1 wherein said at least one fluorescent tube is a low wattage fluorescent tube.

4. The display base of claim 1 wherein said transformer's means to attach to a 120 volt outlet are male contact blades.

5. The display base of claim 1 wherein said side walls and said bottom portion adapted to mount at least one fluorescent tube and fluorescent starter are reflective white.

6. The display base of claim 1 wherein said conductor means from said transformer is a low voltage wire.

7. The display base of claim 6 wherein said low voltage wire is bell wire.

8. The display base of claim 1 wherein said case is made of plastic.

9. The display base of claim 8 wherein said plastic is high-impact styrene.

10. The display base of claim 1 wherein said fluorescent tube and fluorescent starter are mounted on a base attachable to said bottom portion.

11. The display base of claim 1 wherein said fluorescent starter includes a printed circuit board.

12. The display base of claim 11 wherein said printed circuit board includes a low voltage AC step-up transformer.

* * * * *

UNITED STATES PATENT AND TRADEMARK OFFICE

CERTIFICATE OF CORRECTION

PATENT NO. : 4,716,503

DATED : December 29, 1987

INVENTOR(S) : Richard L. Chappell, et al

It is certified that error appears in the above-identified patent and that said Letters Patent is hereby corrected as shown below:

Claim 1, line 4, delete "an open"

line 4, before "bottom" insert -- a -- line 5, delete "an inward flange,"

lines 7 and 8, delete "integrally attached to"

line 8, before "said" insert -- at -- lines 8 and 9, delete "portion of said case at said flange"

lines 9 and 10, delete "adapted to be engageably held"

line 10, delete "open"

Signed and Sealed this

Nineteenth Day of April, 1988

*Attest:*

*Attesting Officer*

DONALD J. QUIGG

*Commissioner of Patents and Trademarks*